US010494861B2

(12) United States Patent
Schwandt et al.

(10) Patent No.: US 10,494,861 B2
(45) Date of Patent: Dec. 3, 2019

(54) HANDLE ASSEMBLY FOR AN ARCHITECTURAL OPENING

(71) Applicant: Hunter Douglas Inc., Pearl River, NY (US)

(72) Inventors: Mark A. Schwandt, Thornton, CO (US); Jeffrey L. Spray, Erie, CO (US)

(73) Assignee: HUNTER DOUGLAS INC., Pearl River, NY (US)

( * ) Notice: Subject to any disclaimer, the term of this patent is extended or adjusted under 35 U.S.C. 154(b) by 478 days.

(21) Appl. No.: 15/045,309

(22) Filed: Feb. 17, 2016

(65) Prior Publication Data

US 2017/0234063 A1 Aug. 17, 2017

(51) Int. Cl.

| | |
|---|---|
| ***B25G 3/00*** | (2006.01) |
| ***E06B 9/326*** | (2006.01) |
| ***E06B 9/32*** | (2006.01) |
| ***E06B 9/262*** | (2006.01) |
| ***E06B 9/38*** | (2006.01) |
| ***E05B 1/00*** | (2006.01) |

(52) U.S. Cl.

CPC ..... *E06B 9/32* (2013.01); *E05B 1/0015* (2013.01); *E06B 9/262* (2013.01); *E06B 9/326* (2013.01); *E06B 9/38* (2013.01); *E06B 2009/2627* (2013.01)

(58) Field of Classification Search

CPC ..... E06B 2009/425; E06B 9/32; E06B 9/78; E06B 9/322; E06B 2009/322; E06B 2009/2627; E06B 9/38; E06B 9/262; B25G 3/00; E05B 1/0015; Y10T 16/509; A47B 95/02

USPC ..... 16/DIG. 24, 416, 443

See application file for complete search history.

(56) References Cited

U.S. PATENT DOCUMENTS

| | | | | | |
|---|---|---|---|---|---|
| 319,644 | A * | 6/1885 | Tweed | A47B 95/02 | 16/414 |
| 820,231 | A * | 5/1906 | Merryweather | E05B 1/0015 | 16/444 |
| 1,892,087 | A | 12/1932 | Stuber | | |
| 2,200,158 | A * | 5/1940 | Clarke | E05B 1/0015 | 248/222.11 |
| 2,458,754 | A * | 1/1949 | Wallace | E05B 1/0015 | 16/444 |
| 2,624,906 | A * | 1/1953 | Foster | E06B 3/44 | 16/429 |
| 2,796,627 | A * | 6/1957 | Heyer | E05B 1/0015 | 16/417 |
| 2,865,044 | A | 12/1958 | Bielek | | |
| 2,882,549 | A * | 4/1959 | Strauss | E05B 1/0015 | 16/412 |
| 3,151,350 | A * | 10/1964 | Manion | E05B 1/0015 | 16/402 |
| 3,156,944 | A * | 11/1964 | Bohn | E05B 1/0015 | 16/412 |

(Continued)

FOREIGN PATENT DOCUMENTS

EP 1353037 A2 10/2003

*Primary Examiner* — Daniel P Cahn

(57) ABSTRACT

A handle assembly for an architectural covering is provided. The covering may include a shade member, a movable rail attached to the shade member, and a handle secured to the movable rail. The handle may be secured to the rail in a manner that results in a smooth, relatively uninterrupted appearance.

12 Claims, 7 Drawing Sheets

(56) References Cited

U.S. PATENT DOCUMENTS 3,470,764 A * 10/1969 Frymire ..... E06B 7/084 49/87.1
3,581,798 A 1/1971 Malamed
3,692,155 A 9/1972 Laurita
4,687,041 A 8/1987 Anderson
4,732,430 A * 3/1988 Byrns ..... A47B 88/95 312/330.1
4,744,126 A * 5/1988 Bisbing ..... A45C 13/26 16/443
4,831,678 A * 5/1989 Dietsche ..... B25G 3/08 15/106
4,884,615 A 12/1989 Hsu
4,911,348 A * 3/1990 Rasor ..... B60R 9/045 224/321
5,265,307 A 11/1993 Hull et al.
5,937,929 A 8/1999 Chen
6,536,503 B1 3/2003 Anderson et al.
6,871,385 B2 * 3/2005 Wing ..... E05B 1/0015 16/436
7,175,377 B2 2/2007 Womack
7,389,565 B2 6/2008 Cheng
7,571,960 B2 * 8/2009 Williams ..... A47C 7/00 297/183.7
D616,721 S * 6/2010 Glass ..... D8/313
7,802,608 B2 9/2010 Anderson et al.
D647,777 S * 11/2011 Franssen ..... D8/107
8,307,515 B2 * 11/2012 Ramsauer ..... E05B 1/0015 16/413
9,702,185 B2 * 7/2017 Jelic ..... E06B 9/34
9,708,850 B2 * 7/2017 Anderson ..... E06B 9/322
9,757,851 B2 * 9/2017 Meinzer ..... B25F 1/02
2002/0157796 A1 10/2002 Judkins
2002/0174961 A1 11/2002 Anderson et al.
2004/0131439 A1 7/2004 Womack et al.
2005/0224192 A1 * 10/2005 Hsu ..... E06B 9/324 160/178.2
2006/0162127 A1 * 7/2006 Huang ..... E05B 1/0015 16/412
2007/0074826 A1 * 4/2007 Jelic ..... A47H 23/04 160/84.05
2007/0084567 A1 4/2007 Chen
2008/0083509 A1 * 4/2008 Hsu ..... E06B 9/32 160/84.05
2008/0115894 A1 * 5/2008 Cech ..... E06B 9/36 160/168.1 V
2009/0106942 A1 4/2009 Dell'Orfano
2010/0065227 A1 * 3/2010 Murphy ..... E06B 9/262 160/172 R
2012/0097349 A1 4/2012 Chen
2012/0222824 A1 * 9/2012 Lin ..... E06B 9/262 160/25
2012/0227912 A1 * 9/2012 Anderson ..... E06B 9/32 160/87
2012/0267056 A1 10/2012 Ko
2013/0269131 A1 * 10/2013 Mallett ..... A46B 5/00 15/144.1
2014/0076504 A1 3/2014 Anthony et al.
2014/0138036 A1 * 5/2014 de Vries ..... E06B 9/307 160/176.1 R
2014/0138280 A1 * 5/2014 Meinzer ..... B25F 1/02 206/577
2014/0158314 A1 * 6/2014 Anderson ..... E06B 9/322 160/368.1
2015/0013921 A1 * 1/2015 Franssen ..... E06B 9/388 160/84.04
2015/0020982 A1 * 1/2015 Anderson ..... E06B 9/324 160/298
2015/0034262 A1 2/2015 Franssen
2015/0197984 A1 * 7/2015 Anderson ..... E06B 9/322 160/298
2015/0259977 A1 * 9/2015 Anderson ..... E06B 9/262 160/168.1 R
2015/0259978 A1 9/2015 Lin et al.
2015/0328766 A1 * 11/2015 Brogden ..... A01B 1/20 56/400.04
2016/0010389 A1 * 1/2016 Anderson ..... E06B 9/322 188/65.1
2017/0234062 A1 * 8/2017 Schwandt ..... E06B 9/266 160/40
2017/0314325 A1 * 11/2017 Anderson ..... E06B 9/324
2019/0032403 A1 * 1/2019 Chen ..... E06B 9/322
2019/0112871 A1 * 4/2019 Huang ..... E06B 9/322

* cited by examiner

HANDLE ASSEMBLY FOR AN ARCHITECTURAL OPENING

TECHNICAL FIELD

This invention relates generally to coverings for architectural openings, and more specifically to a handle assembly for architectural covering.

BACKGROUND

Coverings for architectural openings, such as windows, doors, archways, and the like, have taken numerous forms for many years. Some coverings include a retractable shade member that is movable between an extended position and a retracted position. A movable rail typically is attached to an edge of the shade member to facilitate extension of the shade member across the opening and to maintain the shade member in a desired configuration. Some movable rails include a handle assembly that facilitates a user moving the movable rail across the opening. Some handle assemblies loosely attach to the movable rail, are not aesthetically pleasing, or both.

BRIEF SUMMARY

The present disclosure generally provides a handle assembly for an architectural covering that offers improvements or an alternative to existing arrangements. The handle assembly is associated with a movable rail in a manner that does not interfere with operation of the covering. For example, when connected to the movable rail, the handle assembly allows full extension and/or retraction of the covering without interference. In a preferred embodiment, the handle assembly is coupled to the movable rail such that the manner of coupling is not visually apparent.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. It should be understood that the claimed subject matter is not necessarily limited to the particular embodiments or arrangements illustrated herein.

BRIEF DESCRIPTION OF THE DRAWINGS

The accompanying drawings, which are incorporated into and constitute a part of the specification, illustrate embodiments of the disclosure and, together with the general description above and the detailed description below, serve to explain the principles of these embodiments.

DETAILED DESCRIPTION

Typically, a handle is coupled to an architectural covering, such as to a rail of an architectural covering, to facilitate movement of the architectural covering between extended and retracted positions covering or uncovering an architectural opening. In accordance with various principles of the present disclosure, a handle is coupled to an architectural covering in one or more enhanced manners. In one embodiment, the handle is coupled to the architectural covering in a manner that conceals the coupling structure, thereby resulting in a smooth or "clean" or streamlined appearance, with the handle simply adjoined to, such as abutting, a portion of the architectural covering, such as a rail thereof, without the manner in which such adjoining is achieved readily visible to an observer. Preferably, the portion of the architectural covering to which the handle is coupled has a coupling element formed or provided thereon which is concealed by the handle when the handle is coupled thereto such that the manner in which the handle is coupled to the portion of the architectural covering is not evident once coupling has been achieved. In one embodiment, separate and independent from the aforementioned embodiment yet combinable therewith if desired, the handle is coupled to a rail of an architectural covering so that the handle does not interfere with (such as by being spaced from and not contacting) a shade member (i.e., an element which functions to cover the architectural opening, such as a material, fabric, honeycomb, pleated, or other covering structure or element) of the architectural covering.

Figure 1:
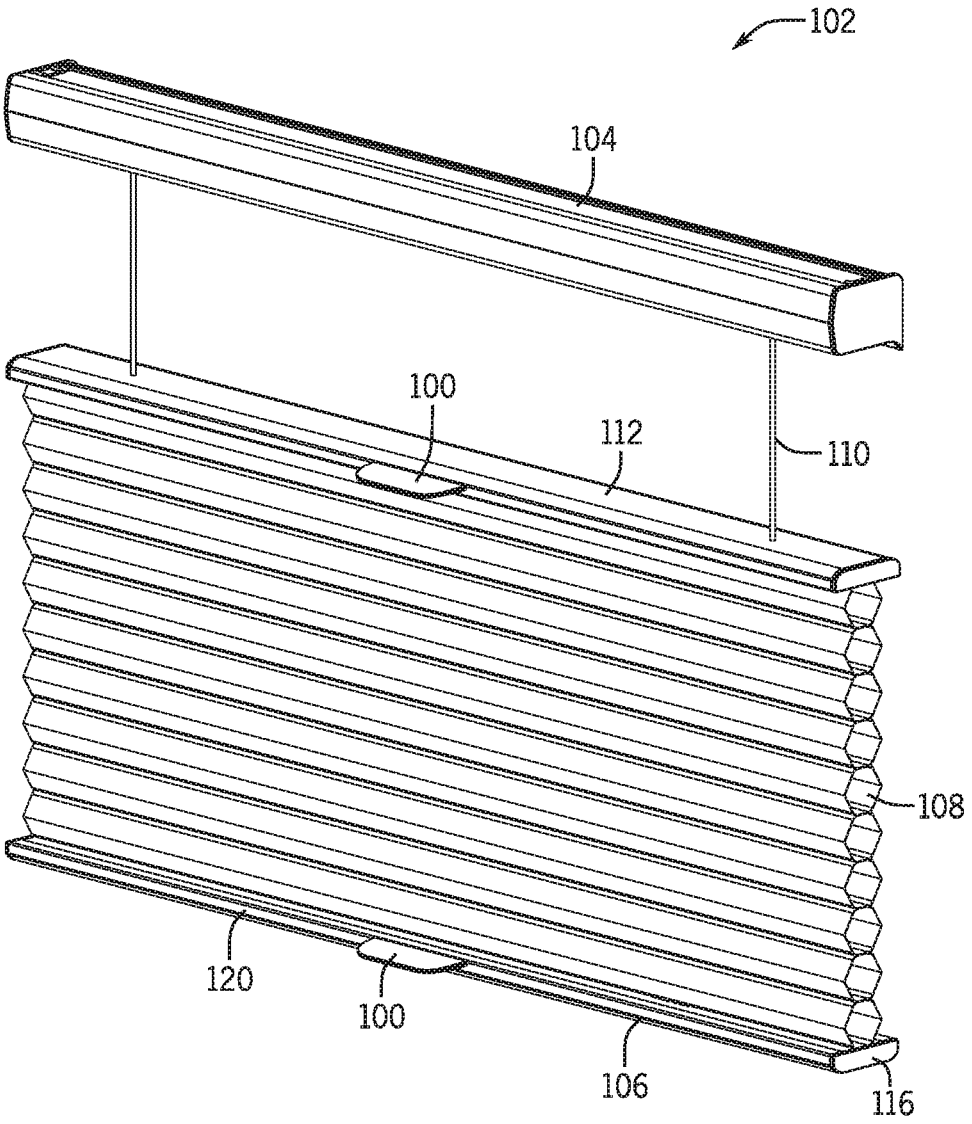
FIG. 1 is a front view of a covering in accordance with an embodiment of the present disclosure.

FIG. 1 is a front view of an illustrative embodiment of a handle 100 attached to a covering 102 and formed in accordance with principles of the present disclosure. As illustrated, the handle 100 is operable to move the covering 102 between open and closed and/or extended and retracted configurations, including a fully-extended, partially-open configuration illustrated in FIG. 1. In one embodiment, the covering 102 includes a head rail 104, a bottom rail 106, a shade member 108 extending between the head rail 104 and the bottom rail 106 and configured to cover an architectural opening when in an extended configuration, and the handle 100 secured to the bottom rail 106. A pair of lift cords 110 extends from the head rail 104 and is connected to the bottom rail 106. The bottom rail 106, which may be referred to as a movable rail, extends horizontally along and is attached to an edge (e.g., a bottom edge) of the shade member 108.

With continued reference to FIG. 1, in some embodiments, the covering 102 may include a movable top rail 112 attached to the shade member 108 opposite the bottom rail 106, the top rail 112 and the bottom rail 106 moving towards and away from the head rail 104 independently from each other to any desired position in the architectural opening, and to any desired amount of coverage of the opening. As shown, the top rail 112 may be configured similarly to the bottom rail 106, and may have a mirrored configuration across the shade member 108. In the embodiment of FIG. 1, the handle 100 may be used to lift, pull, and/or push the bottom rail 106 and/or the top rail 112 (where the handle 100 is mounted on each of the top and bottom rails 112, 106) into desired positions by, for example, a user grasping the handle 100 and directing the bottom rail 106 and/or the top rail 112 towards and/or away from the head rail 104. It will be appreciated that reference herein to the manner in which the handle 100 is coupled to one of the bottom rail 106 or the top rail 112 is applicable to the manner in which the handle 100 is coupled to the other of the bottom rail 106 or the top rail 112.

Figure 2:
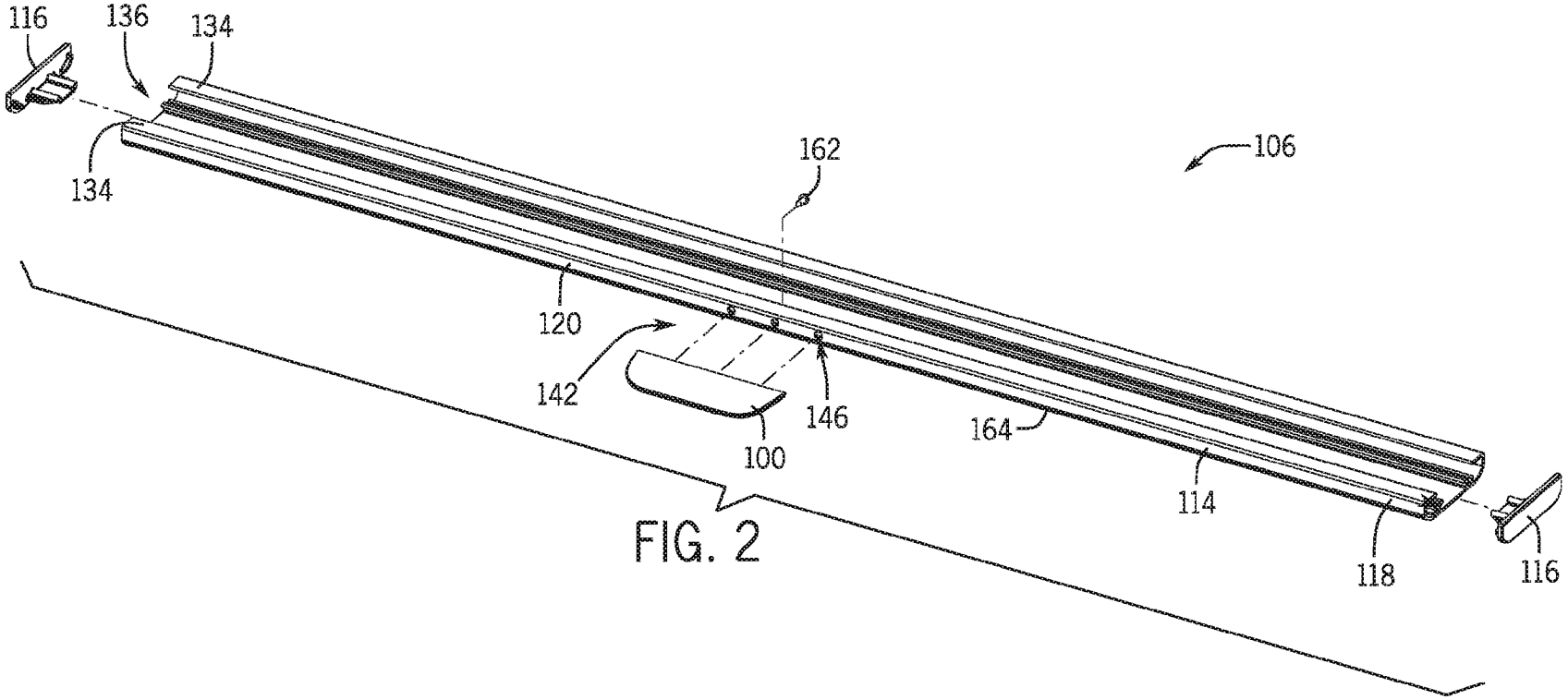
FIG. 2 is a front exploded view of a handle and a movable rail in accordance with an embodiment of the present disclosure.

FIG. 2 is a front exploded view of one embodiment of the handle 100 attached to the bottom rail 106 in accordance with principles of the present disclosure. As shown, the bottom rail 106 includes a rail member 114 having opposing open ends, with the handle 100 secured to the rail member 114. A pair of opposing end caps 116 may each be received in a respective open end to close each end of the rail member 114. Although shown and described with respect to the bottom rail 106, the handle 100 may be associated with the top rail 112 in a similar manner. In the illustrative embodiment of FIG. 2, the rail member 114 is an elongated hollow body having a front wall 118 to which the handle 100 is coupled. The rail member 114 may define a generally rectangular or oval cross section. In some embodiments, the rail member 114 defines a front face 120, a rear face 130, and a bottom face 132 extending between the front and rear faces 120, 130 (see FIG. 6). In some embodiments, the rail member 114 includes opposing flanges 134 extending along the length of the rail member 114, the opposing flanges 134 defining both a slot 136 therebetween and a top surface 138 of the bottom rail 106.

In accordance with one aspect of the disclosure, the handle 100 abuttingly engages a portion of a rail (e.g., the top rail 112 and/or the bottom rail 106) of the architectural covering 102, such as the rail member 114 (although engagement to other portions of the rail is within the scope of the present disclosure, and reference to engagement with the rail member 114 herein is only for the sake of convenience, without intent to limit). More particularly, a rear surface 140 of the handle 100 abuts against a surface of a portion (e.g., the front face 120) of the bottom rail 106. Coupling elements 142 formed on the rear surface 140 of the handle 100 and the surface of a portion of the bottom rail 106 may engage each other to couple the handle 100 and the bottom rail 106 together. The abutment of surfaces, rather than interconnection of surfaces (e.g., fitting of a portion of the handle 100 into a depression or groove in the bottom rail 106), may result in a smoother uninterrupted appearance. In one embodiment, the coupling elements 142 are provided on the handle 100 and the bottom rail 106 of the architectural covering 102 so that when the handle 100 and the bottom rail 106 are coupled together, the coupling elements are concealed and are not readily visible so that the mode of coupling the handle 100 to the architectural covering 102 is not readily detectable or determinable. It will further be appreciated that an uninterrupted smooth exterior surface may be desirable for the rail (e.g., the bottom rail 106) to which the handle 100 is coupled. As such, it may be desirable to form coupling elements or structure in the bottom rail 106 that are limited to the area to which the handle 100 is coupled, and thereby is concealed by the handle 100 once the handle 100 is coupled to the bottom rail 106.

Figure 4:
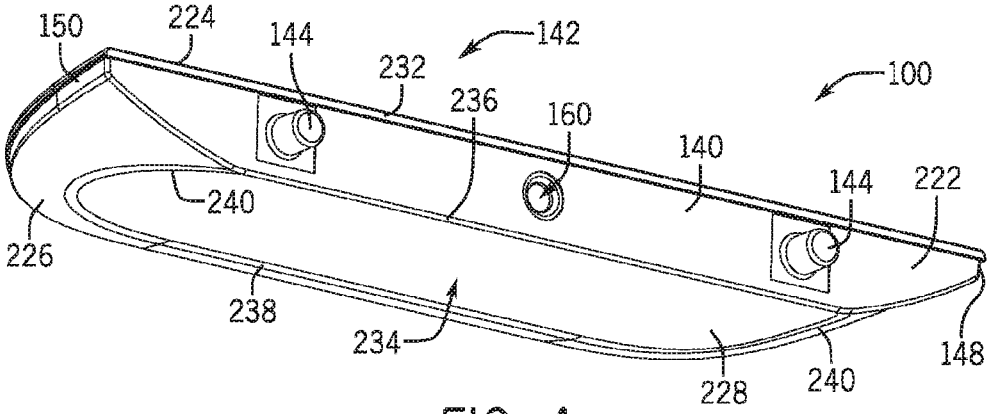
FIG. 4 is a bottom view of the handle of FIG. 3 in accordance with an embodiment of the present disclosure.
Figure 5:
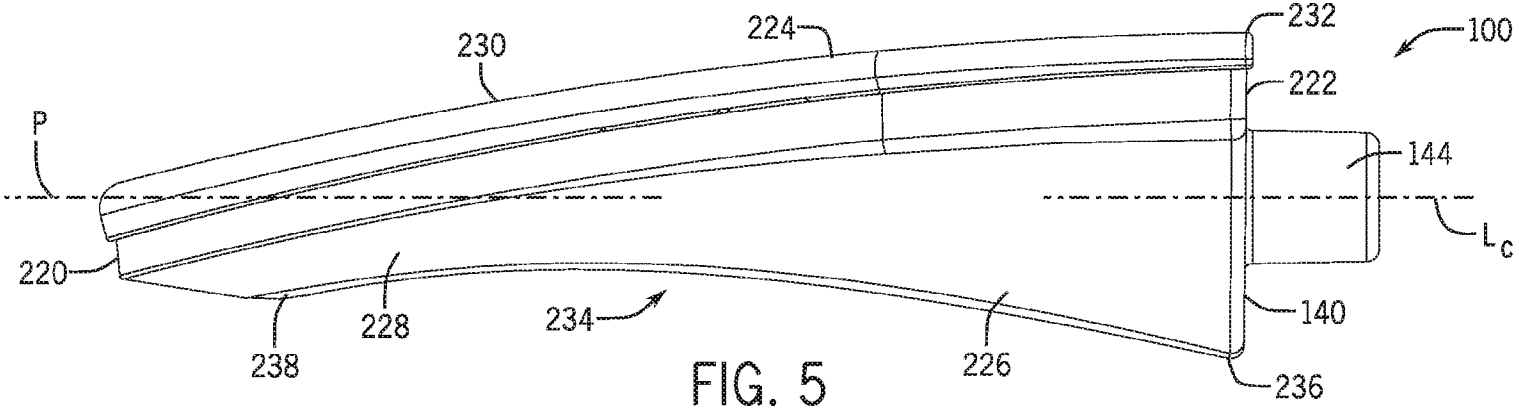
FIG. 5 is an enlarged, side elevation view of the handle of FIG. 3 in accordance with an embodiment of the present disclosure.

As shown in FIGS. 4 and 5, in the illustrated embodiment the handle 100 may be coupled to the bottom rail 106, for instance, via at least one coupler or coupling element, such as a projection 144, and preferably a plurality of projections 144 (e.g., two projections 144), extending from the rear surface 140 of the handle 100 for slidable engagement with corresponding structure defined on/in the bottom rail 106 (see FIG. 2), such as an aperture 146 corresponding to each projection 144, as explained below. Although described below with reference to projections 144, the handle 100 may include substantially any type of coupling or securing mechanism to couple the handle 100 to the bottom rail 106 in a manner in which the coupling is not visible externally. For example without limitation, the handle 100 may be coupled to the bottom rail 106 via adhesive, UV/LED curing, and/or lock features integrated into the projections 144. The lock features may engage at least a portion of the bottom rail 106, as explained more fully below.

The projections 144, which may be referred to as posts or protrusions, may extend transversely, such as at right angles, from the rear surface 140 of the handle 100 and may be spaced substantially equidistant from a vertical mid-line of the handle 100. In one embodiment, each projection 144 is located closer to left and right edges 148, 150, respectively, of the handle 100 than to the vertical mid-line (see FIGS. 3 and 4). In FIG. 4, the projections 144 have a generally cylindrical shape having a substantially circular cross-section; however, other cross-section shapes such as square, rectangle, elliptical, etc. are also possible. As best seen in FIG. 4, the handle 100 may include an additional coupler or coupling element, such as an attachment cavity 160, defined within the rear surface 140 of the handle 100 and preferably positioned between the projections 144. As described below, the attachment cavity 160 is sized to receive a separate coupling element, such as a fastener 162, for attaching the handle 100 to the bottom rail 106 (see FIG. 2). In such embodiments, the fastener 162 is substantially concealed between the handle 100 and the bottom rail 106 so that the mode of coupling the handle 100 to the covering 102 is not readily detectable or determinable. It will be appreciated that although projections 144 are shown on the handle 100 for receipt within structure in the bottom rail 106, the reverse arrangement (e.g., projections on the bottom rail 106 extending into structure in the handle 100) is within the scope of the disclosure.

Figure 6:
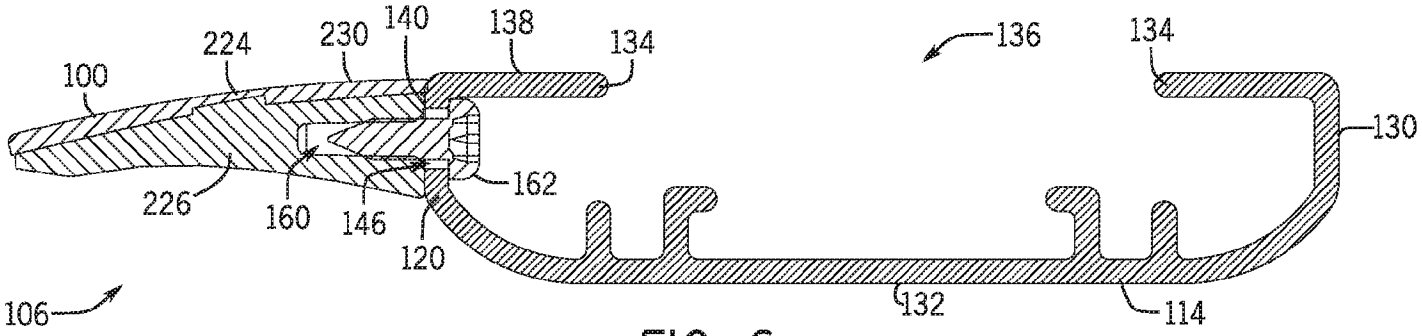
FIG. 6 is an enlarged, cross-sectional view of the movable rail of FIG. 2 in accordance with an embodiment of the present disclosure.

With reference to FIGS. 2, 4, and 6, the handle 100 may be secured to the front face 120 of the rail member 114. In one embodiment, the handle 100 is secured to the rail member 114 at a generally central location along the length of the bottom rail 106. In one example, the handle 100 may be secured to the rail member 114 by the receipt of the at least one projection 144 extending from the handle 100 within a corresponding at least one aperture 146 formed in the front face 120 of the bottom rail 106. Each projection 144 is shaped and sized to fit snugly into the corresponding aperture 146 for a secure fit such that the engagement between the projection(s) 144 and the aperture(s) 146 limits movement of the handle 100 relative to the bottom rail 106. In a preferred embodiment, once engaged the handle 100 does not move, or moves minimally, relative to the bottom rail 106. The location of the aperture(s) 146 locates the position of the handle 100 relative to the length of the bottom rail 106. In this example, the plurality of apertures 146 may be centrally located along the longitudinal length of the bottom rail 106 so the handle 100 is centrally located. As shown, the apertures 146 may be collinear with one another such that the plurality of apertures 146 are parallel to a bottom edge 164 of the bottom rail 106. In the illustrative embodiment of FIG. 2, the receipt of the plurality of projections 144 within the plurality of apertures 146 positionably locates the handle 100 relative to the bottom rail 106 (along the length and height of the bottom rail 106) and inhibits the handle 100 from rotating relative to the bottom rail 106, as more fully described below.

Figure 7:
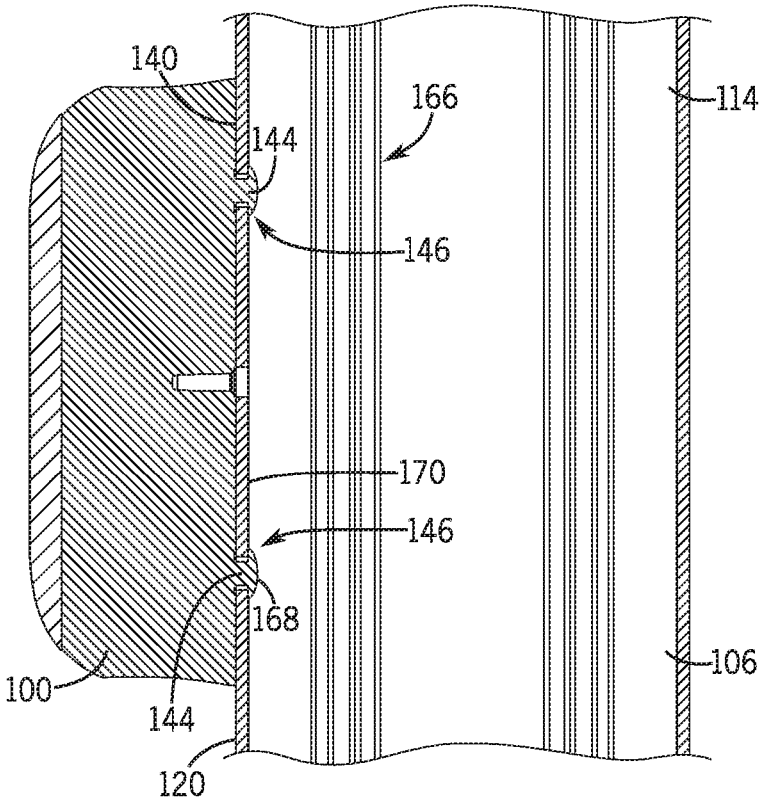
FIG. 7 is an enlarged, cross-sectional view of the movable rail of FIG. 2 showing an additional attachment mechanism in accordance with an embodiment of the present disclosure.

Turning to FIGS. 7-11, in some embodiments, lock features 166 may be integrated into the coupling elements, such as the projections 144, to provide alternative or further attachment means to couple the handle 100 to the bottom rail 106. For example, as shown in FIG. 7, the projections 144 may be formed substantially as swage-like pins. In such embodiments, an outermost portion 168 of each projection 144 may be swaged by a stamp, die, or block to flare, mushroom, and/or flatten the outermost portion 168 of each projection 144 against an interior surface 170 of the front face 120 of the rail member 114 adjacent the aperture 146. Once swaged, at least a portion of the front face 120 may be positioned between the rear surface 140 of the handle 100 and the flared and/or flattened outermost portion 168 of each projection 144 to secure the handle 100 to the bottom rail 106.

Figure 8:
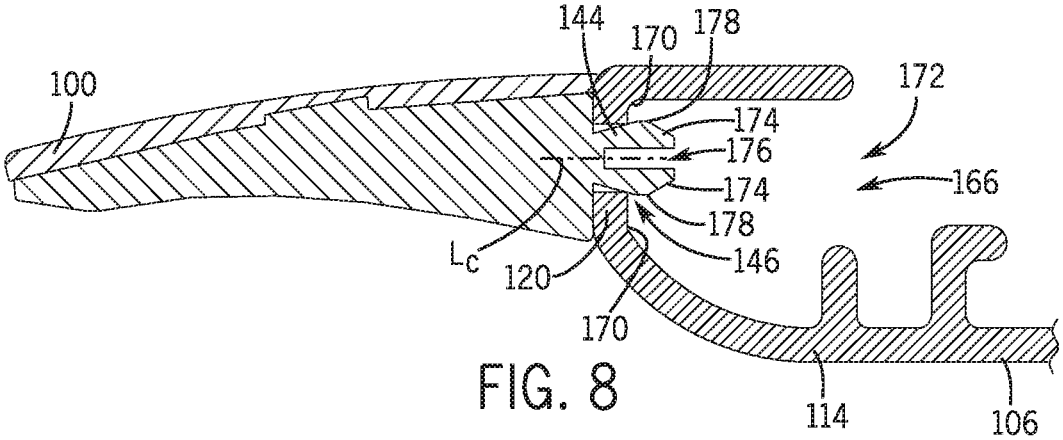
FIG. 8 is an enlarged, cross-sectional view of the movable rail of FIG. 2 showing an additional attachment mechanism in accordance with an embodiment of the present disclosure.

With reference to the FIG. 8, the projections 144 may include at least one snap feature 172 integrated thereon. Each snap feature 172 may include a plurality of resilient arms 174 defining a cavity 176 therebetween, and the arms 174 may be biased to expand outwardly away from the cavity 176. As illustrated in the embodiment of FIG. 8, each arm 174 may include a protrusion 178 extending away from the cavity 176 such that the protrusions 178 define an outer diameter greater than a diameter of the apertures 146. In some embodiments, the protrusions 178 of each projection 144 may collectively extend annularly from a longitudinal centerline $L_c$ of the projection 144. In the embodiments described herein, insertion of the projections 144 within the apertures 146 may create an interference fit to couple the handle 100 to the bottom rail 106. For instance, the arms 174 may resiliently bend, depress, or otherwise deform to collapse the cavity 176 and permit insertion of the projections 144 within the apertures 146. Once the protrusions 178 clear the front face 120 of the rail member 114 during insertion, the arms 174 may expand outwardly to releasably secure the handle 100 to the bottom rail 106 by engaging each protrusion 178 against the interior surface 170 of the front face 120 of the rail member 114. In such embodiments, the biasing effect of the arms 174 expanding outwardly may be sufficient to limit removal of the handle 100 from the bottom rail 106 absent an external force by a user moving the arms 174 to collapse the cavity 176.

Figure 9:
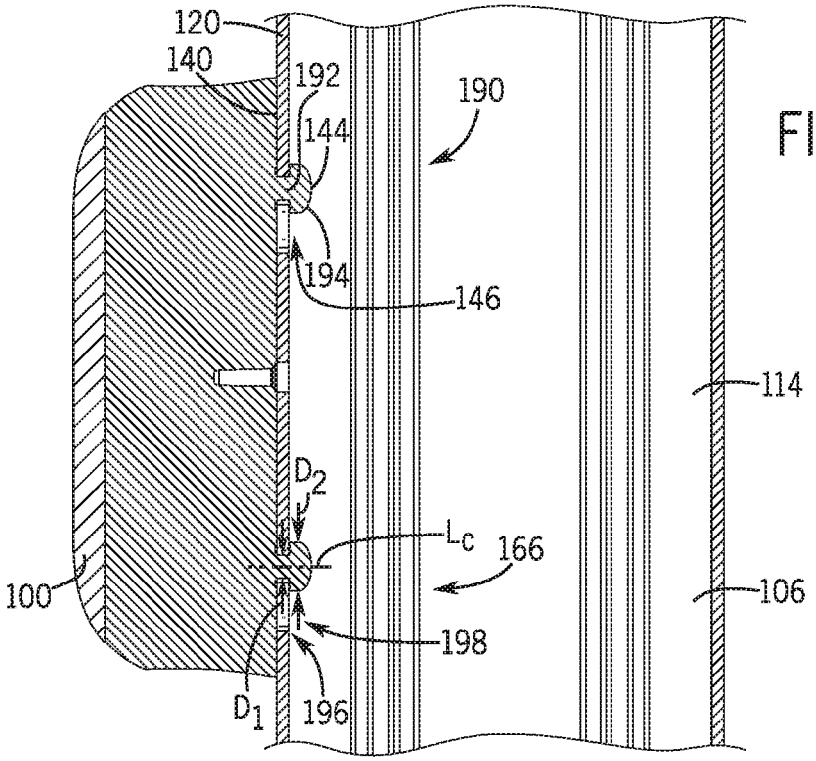
FIG. 9 is an enlarged, cross-sectional view of the movable rail of FIG. 2 showing an additional attachment mechanism in accordance with an embodiment of the present disclosure.

Turning now to FIG. 9, in some embodiments, the lock features 166 may include a sliding lock mechanism 190 to couple the handle 100 to the bottom rail 106. For example, the projections 144 may include a first portion 192 extending from the rear surface 140 of the handle 100 and a second portion 194 extending from the first portion 192, the first and second portions 192, 194 being concentric about the longitudinal centerline $L_c$ of the projection 144. In such embodiments, the first portion 192 may extend away from the rear surface 140 of the handle 100 a distance at least equal to the thickness of the front face 120 of the rail member 114. As illustrated, the projections 144 may include first and second diameters $D_1$, $D_2$, the first diameter $D_1$ defined by the first portion 192 and the second diameter $D_2$ defined by the second portion 194 of the projections 144. The second diameter $D_2$ may be greater than the first diameter $D_1$ to selectively secure the handle 100 to the bottom rail 106.

In one embodiment, the apertures 146 may be sized and shaped to permit sliding movement of the projections 144 therein. For example, the apertures 146 may be keyhole shaped to include one section with a diameter larger than another section such that the projections 144 may be slid in and held in place. In some embodiments, the keyhole shaped apertures 146 may define first and second aperture portions 196, 198 sized and shaped to correspond with the second and first diameters $D_2$, $D_1$ of the projections 144, respectively. To couple the handle 100 to the bottom rail 106, the projections 144 may first be inserted within the first aperture portion 196 until, for example, the second portion 194 of each projection 144 clears the front face 120 of the bottom rail 106. The handle 100 may then be slid transversely along the length of the rail member 114 (i.e., towards one of the end caps 116) to position the first portion 192 of each projection 144 within the second aperture portion 198. Once the handle 100 is coupled to the bottom rail 106, at least a portion of the front face 120 of the rail member 114 may be positioned at least partially between the rear surface 140 of the handle 100 and the second portion 194 of each projection 144.

Figure 10:
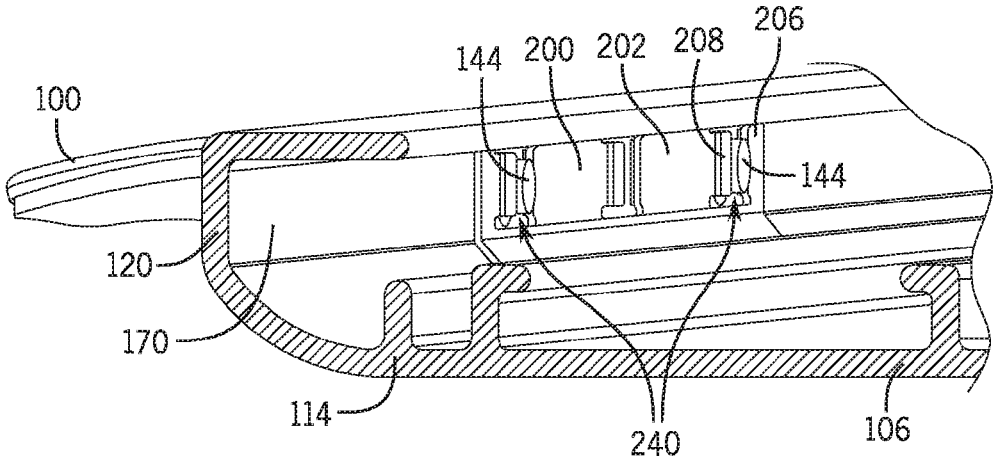
FIG. 10 is an enlarged, fragmentary, isometric view of the movable rail of FIG. 2 showing an additional attachment mechanism in accordance with an embodiment of the present disclosure.
Figure 11:
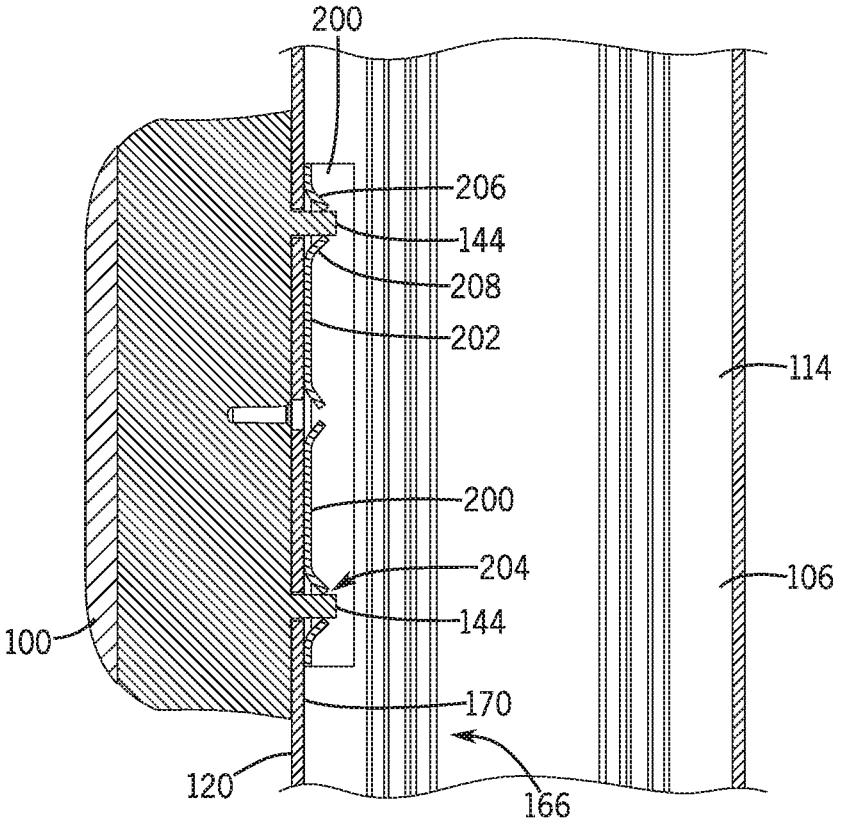
FIG. 11 is an enlarged, cross-sectional view of the attachment mechanism of FIG. 10 in accordance with an embodiment of the present disclosure.

Referring to FIGS. 10 and 11, the lock features 166 may include an attachment plate 200 connected to the projections 144 such that at least a portion of the bottom rail 106 (e.g., the front face 120 of the rail member 114) is sandwiched between the rear surface 140 of the handle 100 and the attachment plate 200. The attachment plate 200 may be releasably or permanently secured to the projections 144. For example, as illustrated in FIG. 10, the attachment plate 200 may be pressed onto the projections 144 to create a spring-like mechanical attachment limiting movement of the handle 100 away from the front face 120 of the rail member 114. In some embodiments, the attachment plate 200 may include a substantially planar first plate member 202 extending parallel to, and in abutting relationship with, the interior surface 170 of the front face 120 of the bottom rail 106. The first plate member 202 may define at least one opening 204 therein to receive a corresponding projection 144. As illustrated, the first plate member 202 may be sized to capture at least two (e.g., all) of the projections 144 of the handle 100, though it is contemplated that separate attachment plates 200 may be connected to each projection 144, if desired.

With continued reference to FIGS. 10 and 11, second and third plate members 206, 208 may extend from the first plate member 202 adjacent each opening 204. As illustrated, the second and third plate members 206, 208 may be positioned diametrically opposite each other about each opening 204 such that when the projections 144 are positioned within the openings 204, the projections 144 are positioned at least partially between the second and third plate members 206, 208. In such embodiments, a distance between the second and third plate members 206, 208 may be less than a diameter of the projections 144. In this manner, once the attachment plate 200 is pressed onto the projections 144, the second and third plate members 206, 208 may engage a corresponding projection 144 through interference fit. For example, since the distance between the second and third plate members 206, 208 may be less than a diameter of the projections 144, once a projection 144 is inserted within the opening 204, the second and third plate members 206, 208 may necessarily deform such that the second and third plate members 206, 208 extend at an angle away from the interior surface 170 of the rail member 114 to tightly engage the projections 144. In such embodiments, any movement of the handle 100 away from the bottom rail 106 may cause the second and third plate members 206, 208 to move towards the interior surface 170 of the rail member 114. Because the second and third plate members 206, 208 are constrained by the first plate member 202, such movement only tightens the engagement between the second and third plate members 206, 208 and the projections 144, thereby limiting removal of the handle 100 from the bottom rail 106. Though described independently above, each of the lock features 166 may be combinable with one another to couple the handle 100 to the bottom rail 106.

With reference to FIG. 2, to secure the handle 100 to the bottom rail 106, in addition to the engaging couplers discussed above, the fastener 162 may be inserted within one of the plurality of apertures 146 (e.g., a middle aperture) and is connected to the handle 100. In some embodiments, the plurality of projections 144 are spaced sufficiently apart to allow the fastener 162 to be located interspersed (e.g., between) the plurality of projections 144. In such embodiments, the projections 144 extend into the apertures 146 on either side of the fastener 162 and act to hold the handle 100 in position while the fastener 162 is tightened, for instance. Otherwise, the handle 100 might rotate or move relative to the bottom rail 106, making it difficult to fully tighten the fastener 162 and/or to maintain the desired position of the handle 100 relative to the rail member 114. With reference to FIG. 1, once the covering 102 is assembled, the apertures 146 of the bottom rail 106, the projections 144 of the handle 100, and the coupling elements, such as without limitation the fastener 162, including the lock features 166 are not visible from at least a front view of the covering 102 during operation.

FIG. 6 is an enlarged, cross-sectional view of an illustrative embodiment of the bottom rail 106 in accordance with principles of the present disclosure. As shown in FIG. 6, the handle 100 is attached to the front face 120 of the rail member 114. In some embodiments, the handle 100 may be cantilevered from the front face 120, which may be referred to as an elongated side surface or a front portion. In such embodiments, to secure the handle 100 to the bottom rail 106, the rear surface 140 of the handle 100 is adapted to abuttingly engage a front portion (e.g., the front face 120) of the rail member 114 so that the manner in which the handle 100 is coupled to the rail member 114 is not readily apparent upon visual inspection. For instance, as in the illustrated embodiments, the projections 144 of the handle 100 are received within the apertures 146 of the rail member 114 and the overall appearance of the handle 100 and the rail member 114 is relatively continuously smooth. As shown, the fastener 162 is inserted from within an interior of the rail member 114, through one of the apertures 146, and into the attachment cavity 160 of the handle 100. The fastener 162 and/or the attachment cavity 160 may be sized such that threads of the fastener 162 engage an interior surface of the attachment cavity 160. In some embodiments, the attachment cavity 160 may be tapped to include internal threads sized to match corresponding external threads of the fastener 162. Once assembled, the handle 100 and the rail member 114 may be firmly attached together so the handle 100 does not move relative to the rail member 114. In the embodiment of FIG. 6, the opposing flanges 134 of the rail member 114 conceal the fastener 162 and/or the apertures 146 of the bottom rail 106 from at least a front side view of the covering 102.

In one embodiment, the handle 100 may be secured to the bottom rail 106 such that the handle 100 allows full extension and/or retraction of the covering 102 without interference (e.g., between the bottom rail 106 and the head rail 104 and/or the shade member 108), as explained in more detail below. A relatively smooth, uninterrupted appearance may thus be obtained, with the handle 100 being coupled to the rail member 114 without affecting the appearance of the shade member 108 relative to the rail member 114.

Figure 3:
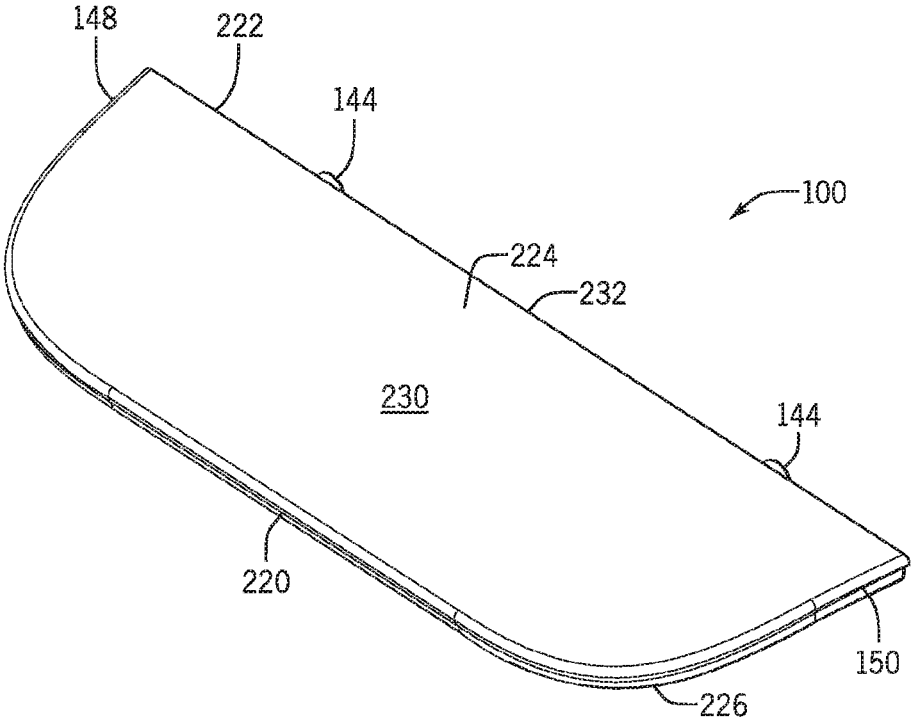
FIG. 3 is a top view of a handle in accordance with an embodiment of the present disclosure.

FIG. 3 is a top view of an illustrative embodiment of the handle 100 in accordance with principles of the present disclosure. FIG. 4 is a bottom view of an illustrative embodiment of the handle 100 in accordance with principles of the present disclosure. FIG. 5 is a side elevation view of an illustrative embodiment of the handle 100 in accordance with principles of the present disclosure. As illustrated in FIGS. 3-5, the handle 100, which may be referred to as a handle assembly, has a front edge 220 and a rear edge 222. In some embodiments, the handle 100 may include a top member 224 and a bottom member 226. As shown in FIGS. 3-5, the top and bottom members 224, 226 may be sized such that attachment of the top and bottom members 224, 226 to the bottom rail 106 is within the limits of the bottom rail 106 (see FIGS. 1 and 6). The top and bottom members 224, 226 have generally coextensive perimeters in the examples illustrated in FIGS. 3-5. However, in some instances the top member 224 may overhang the bottom member 226 along at least the front edge 220 of the handle 100. To blend the look of the handle 100 aesthetically with the bottom rail 106, the handle 100 preferably includes smooth lines and the overall thickness of the handle 100 in one embodiment generally increases from the front edge 220 to the rear edge 222 of the handle 100 (see FIG. 5).

As best seen in the embodiment of FIG. 5, a portion of the top member 224 may connect to the bottom member 226 at or below a plane P defined by extensions of the longitudinal centerlines $L_c$ of the projections 144. In this manner, the handle 100 may provide a gripping feature (e.g., a lip) for a user to firmly grasp the handle 100 while simultaneously positioning a bottom surface 228 of the handle 100 such that a portion of the bottom surface 228 adjacent the front face 120 does not extend below the bottom face 132 of the bottom rail 106, for instance, especially in embodiments having a thin movable rail.

Referring to FIGS. 3 and 5, the top member 224 of the illustrative embodiment of the handle 100 has a relatively thin and constant thickness dimension. As illustrated, the top member 224 has a smooth top surface 230, which in some embodiments, may be convexly-profiled to create a desired aesthetic characteristic. In such embodiments, the top member 224 has a relatively constant radius of curvature such that the top surface 230 is downwardly-sloping from an upper rear edge 232 of the handle 100 to the front edge 220 of the handle 100. In some embodiments, the top surface 230 of the top member 224 does not extend above the top surface 138 of the bottom rail 106 so as to not interfere with the bottom rail 106 or with the interface between the bottom rail 106 and the shade member 108 and/or the top rail 112 (see FIG. 6). For example, as shown in FIG. 6, the top member 224 of the handle 100 may be positioned adjacent one of the opposing flanges 134 such that the top surface 230 of the handle 100 is substantially coextensive with or positioned below the top surface 138 of the flange 134. As such, the top surface 230 of the handle 100 and the top surface of the rail member 114 (such as formed by the top surface 138 of the flange 134) may provide a substantially uniform appearance. Moreover, whereas prior art handles have surrounded a rail so that a portion of the handle has been inserted between the rail and the shade member, thereby displacing and somewhat distorting the shade member, the top of the handle 100 of the illustrated embodiment does not extend between the bottom rail 106 and the shade member 108 and may not even contact the shade member 108 at all.

Referring to FIGS. 4 and 5, the bottom member 226 of an illustrative embodiment of the handle 100 varies in thickness ranging from a thin front edge to a thicker rear edge defining the rear surface 140. As shown, the bottom surface 228 may be textured to provide a gripping feature for a user's fingers, the bottom surface 228 being positioned opposite the top surface 230 of the top member 224. In some embodiments, the bottom surface 228 does not extend below the bottom face 132, which may be referred to as a bottom surface, of the bottom rail 106 so as to not interfere with the bottom rail 106 or with the interface between the bottom rail 106 and the architectural opening (e.g., a sill).

In the illustrative embodiments of FIGS. 4 and 5, the bottom member 226 in one embodiment includes a concave portion 234 defined within a portion of, such as a majority of, the bottom surface 228. In such embodiments, the bottom surface 228 provides a concave grip surface which may be more comfortable than a flat surface that is not curved. The bottom surface 228 may be concavely-sloping from a lower rear edge 236 of the handle 100 to the front edge 220 of the handle 100. As best seen in FIGS. 4 and 5, the outer periphery of the concave portion 234 defines an arcuate ridge line 238 that extends from the lower rear edge 236 towards the front edge 220 of the handle 100 and adjacent a significant portion of the front edge 220. Terminal ends 240 of the ridge line 238 may intersect the lower rear edge 236 at a non-perpendicular angle relative to the rear surface 140 (see FIG. 4) to define a desired aesthetic characteristic. In the illustrative embodiment of FIG. 4, the bottom member 226 decreasingly tapers from the ridge line 238 towards the front, left, and right edges 220, 148, 150, respectively, of the handle 100 to define a desired aesthetic characteristic. With reference to FIG. 5, when viewed from the side, the bottom member 226 tapers upwardly from the rear surface 140 to a substantial midpoint of the handle 100, at which the bottom member 226 tapers downwardly to the front edge 220.

The handle 100 may be constructed of substantially any type of material. For example, the handle 100 may be constructed from natural and/or synthetic materials, including metals, ceramics, plastics, and/or other suitable materials. Plastic materials may include thermoplastic material (self-reinforced or fiber-reinforced), ABS, polycarbonate, polypropylene, polystyrene, PVC, polyamide, or PTFE, among others. In some embodiments, the top member 224 may be formed from a first material, and the bottom member 226 may be formed from a second material. The bottom member 226 may be opaque and pigmented to correspond with the color of the bottom rail 106, the shade member 108, and/or other components of the covering 102.

The foregoing description has broad application. It should be appreciated that the concepts disclosed herein may apply to many types of shades, in addition to the shades described and depicted herein. Similarly, it should be appreciated that the concepts disclosed herein may apply to many types of rails, in addition to the bottom rail 106 described and depicted herein. For example, the concepts may apply equally to the top rail 112 or any other rail movable through a handle assembly. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. An architectural covering comprising:

a shade configured to extend and retract to cover or uncover an architectural opening;

a movable rail attached to said shade, said rail including an interior cavity, a front surface, and at least three apertures extending completely through said front surface of said movable rail, said at least three apertures being in communication with said interior cavity;

a handle including a rear surface, said handle including at least two projections extending from said rear surface of said handle and an opening positioned between said at least two projections, said at least two projections being arranged and configured to be positioned within two of said at least three apertures to hold said handle in position relative to said movable rail; and a fastener arranged and configured to be inserted through one of said at least three apertures in said rail and said opening in said handle to secure said handle to said movable rail;

wherein when said handle is coupled to said movable rail said at least three apertures, said at least two projections, and said fastener are concealed between said handle and said movable rail.

2. The covering according to claim 1, wherein said handle is cantilevered from a front portion of said movable rail.

3. The covering according to claim 1, wherein:

said handle includes a top surface and a bottom surface;

said top surface does not extend above a top surface of said movable rail; and said bottom surface does not extend below a bottom surface of said movable rail.

4. The covering according to claim 1, wherein said movable rail is a bottom rail.

5. The covering according to claim 4, further comprising:

a top rail attached to said shade, said top rail positioned opposite said bottom rail and including at least one aperture; and a second handle secured to said top rail, said second handle including at least one projection received within said at least one aperture of said top rail.

6. The covering according to claim 5, wherein:

said handle of said bottom rail does not interfere with said top rail; and said second handle of said top rail does not interfere with said bottom rail.

7. The covering according to claim 6, wherein:

said handle includes a top surface;

said second handle includes a bottom surface;

said top surface of said handle does not extend above a top surface of said bottom rail; and said bottom surface of said second handle does not extend below a bottom surface of said top rail.

8. The covering according to claim 5, wherein:

said top rail includes a front surface; and said second handle includes a rear surface; and a coupling element configured to couple said second handle to said top rail, wherein when said second handle is coupled to said top rail said second coupling element is concealed between said second handle and said top rail.

9. The covering according to claim 1, wherein the handle includes:

a top member defining a convex profile;

a bottom member connected to said top member, said bottom member including said rear surface; and said at least two projections extend from said rear surface of said bottom member, each of said at least two projections have a longitudinal centerline, wherein a portion of said top member connects to said bottom member at or below a plane defined by an axis of said longitudinal centerlines of said at least two projections.

10. The covering according to claim 9, wherein said bottom member includes a concave portion defined within a majority of an exterior surface of said bottom member.

11. The covering according to claim 9, wherein said top member is formed from a first material, and wherein said bottom member is formed from a second material.

12. The covering according to claim 1, wherein said rear surface of said handle is adapted to contact said front surface of said movable rail.

* * * * *